US005139449A

United States Patent [19]

Akahori

[11] Patent Number: 5,139,449

[45] Date of Patent: Aug. 18, 1992

[54] RUST PREVENTIVE TREATMENT METHOD FOR ALUMINUM BASIS MATERIAL AND OUTBOARD MOTOR BODY OF ALUMINUM MAKE

[75] Inventor: Sadao Akahori, Hamamatsu, Japan

[73] Assignee: Honda Giken Kogyo Kabushiki Kaisha, Tokyo, Japan

[21] Appl. No.: 593,134

[22] Filed: Oct. 5, 1990

[51] Int. Cl.[5] ..... B63H 5/12

[52] U.S. Cl. ..... 440/76

[58] Field of Search ..... 440/53, 76, 113; 114/222; 204/147; 106/14.21, 14.45, 14.33

[56] References Cited

U.S. PATENT DOCUMENTS 4,343,660 8/1982 Martin ..... 204/147

5,009,619 4/1991 Meier ..... 440/113

FOREIGN PATENT DOCUMENTS 1-036778 2/1989 Japan ..... 440/76

2-44914 10/1990 Japan .

OTHER PUBLICATIONS

Mercury brochure, "The Corrosion Solution", Mercury Outboards, Fond Du Lac, Wis., 1985.

*Primary Examiner*—Jesûs D. Sotelo

*Assistant Examiner*—Stephen P. Avila

*Attorney, Agent, or Firm*—Armstrong, Nikaido, Marmelstein, Kubovcik & Murray

[57] ABSTRACT

A rust preventive method for an aluminum basis material comprises the steps of forming an anodic oxide film on a surface of a basis material made of aluminum or aluminum alloy, sealing the anodic oxide film with molybdenum disulfide, and forming at least one paint coat on top of the film thus obtained. An outboard motor body of aluminum or aluminum alloy has on a surface of it an anodic oxide film sealed with molybdenum disulfide and at least one paint coat on top of the film thus obtained.

20 Claims, 1 Drawing Sheet

RUST PREVENTIVE TREATMENT METHOD FOR ALUMINUM BASIS MATERIAL AND OUTBOARD MOTOR BODY OF ALUMINUM MAKE

BACKGROUND OF THE INVENTION

1. Field of the Invention

This invention relates to a rust preventive treatment method for an aluminum basis material such as an outboard motor body or the like made of aluminum or aluminum alloy, and to an outboard motor body which is treated by this rust preventive treatment method.

2. Description of the Related Art

Conventionally, it is normal practice to construct a body of an outboard motor by a die-cast aluminum alloy such, for example, as AlADC 12 of JIS/H 5302 (which is equivalent to ASTM SC 114A, i.e., consisting of 1.5-3.5% Cu, 10.5-12.0% Si, less than 0.3% Mg, less than 1.0% Zn, less than 1.3% Fe, less than 0.5% Mn, less than 0.5% Ni, less than 0.3% Sn, and Al for the remaining percent). This alloy is likely to be easily corroded because it contains about 2 to 3% of copper. Therefore, conventionally it is practiced in general, as shown in FIG. 3, to form on a surface of a diecast basis material a for the outboard motor body, a chromate film b by treatment with chromic acid for rust prevention, and on top thereof a three-layer paint coat comprising a primer c containing a rust preventive pigment consisting of zinc chromate, a top coat d and a clear coat e.

The above-described chromate film b is as thin as about 10 to 100 angstroms, and the basis material a for the outboard motor body is easily exposed by scratches or the like. In addition, since this chromate film b is susceptible to heat, cracks are likely to be generated at the time of baking of the paint. As a consequence, rusts are formed in 500 to 600 hours in salt spray test.

In the Japanese Published Examined Patent Application No. 4155/Showa 56 (1981) and others, an art is disclosed in which an anodic oxide film is formed on a surface of an aluminum basis material made of aluminum or aluminum alloy in order to improve its wear resistivity, and then the anodic oxide film is sealing-treated with molybdenum disulfide in order to provide the film with lubricating characteristics.

Although the above-described art was originally developed for those mechanical parts of aluminum make which require lubricating characteristics, the inventor of this invention has found that the corrosion resistivity of aluminum basis material remarkably improves by forming an anodic oxide film which is sealed with molybdenum disulfide.

An object of this invention is to provide, based on this finding, a rust preventive treatment method for aluminum basis material. Another object of this invention is to provide an outboard motor body which is treated by the above-described rust preventive treatment method and which is superior in corrosion resistivity.

SUMMARY OF THE INVENTION

In order to attain the above-described object, in this invention, an anodic oxide film is formed on a surface of a basis material made of aluminum or aluminum alloy, the anodic oxide film is sealed with molybdenum disulfide, and then at least one paint coat is formed thereon.

According to another aspect of this invention, an outboard motor body made of aluminum or aluminum alloy has on a surface thereof an anodic oxide film which is sealed with molybdenum disulfide and at least one paint coat on top of the anodic oxide film.

BRIEF DESCRIPTION OF THE DRAWINGS

The above and other objects and the attendant advantages of this invention will become more readily apparent by reference to the following detailed description when considered in conjunction with the accompanying drawings wherein.

DETAILED DESCRIPTION OF THE INVENTION

Figure 1:
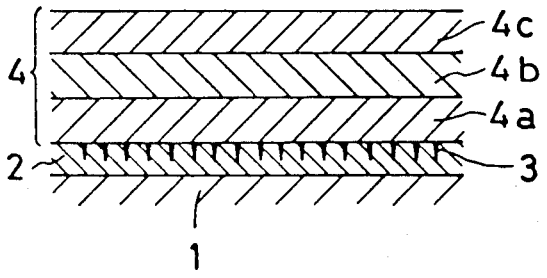
FIG. 1 is a diagrammatical sectional view of a material surface which is subjected to a rust preventive treatment according to this invention method.
Figure 3:
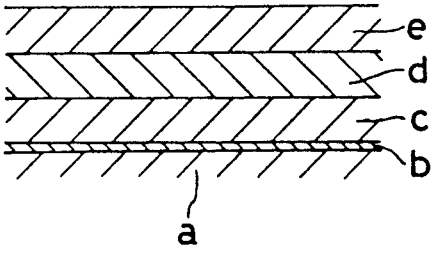
FIG. 3 is a diagrammatical sectional view of a material surface which is subjected to a conventional rust preventive treatment method.

A body basis material 1 of an outboard motor body which is formed by die casting of aluminum basis material such, for example, as aluminum alloy is treated by anodic oxidation to form on the surface of the body basis material 1 an anodic oxide film 2 of 5 to 20 microns thick as shown in FIG. 1. Then, the anodic oxide film 2 is sealed with molybdenum disulfide 3. This sealing treatment with molybdenum disulfide is performed by anodically electrolyzing the body basis material 1 in, for example, an aqueous solution of ammonium thiomolybdate, and then electrodepositing molybdenum disulfide into minute pores in the anodic oxide film 2. After this sealing treatment, the body basis material 1 may be dipped into an aqueous solution of nickel acetate in order to perform another sealing treatment to make the effects of the sealing treatment doubly sure.

Thereafter, painting is performed on the anodic oxide film 2 which has been sealing treated in order to obtain a product. Here, in order to improve the adhesion of the paint as well as to obtain an enhanced rust preventive effect, it is preferable to first paint a primer **4*a* containing a rust preventive pigment and then paint a top coat 4*b* on top of the primer 4*a*. Depending on the necessity, a clear coat 4*c* is further painted on top thereof, thus forming three layers of paint coats 4. As the rust preventive pigment to be mixed in the primer 4*a***, strontium chromate is suitable.

When the anodic oxide film 2 is sealed with molybdenum disulfide 3 as described above, corrosion resistance is remarkably improved as described hereinbelow, though the reason thereof is not clearly known.

A preferred embodiment of this invention method of treating an outboard motor body which is formed by die casting of an aluminum material of AlADC 12 is as follows. First, after the outboard motor body was subjected to a predetermined machining, bearing supports or the like of the motor body were masked with silicone rubber. Then, a degreasing treatment with sulfuric acid or the like and an alkali etching treatment with sodium hydroxide were performed. Thereafter, the motor body was subjected to an anodic oxidation treatment in a sulfuric acid bath to form an anodic oxide film of about 10 micron thick.

Then, after washing with water, the motor body was dipped into an aqueous solution of ammonium thiomolybdate (concentration 0.7 g/l) to perform anodic electrolyzing at an electric current density of 0.25 $A/cm^2$ for 3 to 5 minutes, thereby sealing the anodic oxide film with molybdenum disulfide. After washing with water, the motor body was further dipped into an aqueous solution of nickel acetate (concentration 7 g/l) for about 10 minutes in order to perform another sealing treatment, thereby making the effects of sealing treatment doubly sure. Then, after the motor body was washed with cold water and then with hot water, the masking was removed to finish a pretreatment for painting.

Then, the motor body was painted on its surface with a primer which has as its main agent urethane-modified epoxy ester resin and which is mixed with strontium chromate as a rust preventive pigment, to a thickness of about 25 microns. On top of the primer, a top coat such as a metallic paint and, finally, a clear coat were respectively painted to an about the same thickness as that of the primer.

In order to test the corrosion resistivity, five test pieces were prepared by using the same aluminum basis material as the above-described outboard motor body: i.e., test piece 1 which was subjected to the same rust preventive treatment as the above-described embodiment; test piece 2 in which the primer was not applied; test piece 3 in which the same painting as the above-described embodiment was performed after sealing the anodic oxide film with nickel acetate; test piece 4 in which the same painting as the above-described embodiment was performed without sealing the anodic oxide film; and test piece 5 in which, like in the conventional method, a chromate film was formed, and on top thereof a primer having as its main agent an epoxy ester resin containing a rust preventive pigment consisting of zinc chromate, as well as a top coat and a clear coat were painted. Salt spray tests (according to JIS 3405) were performed on these test pieces, and the widths of generated rusts (i.e., maximum length of filiform rusts or the like which extend sideways after being generated from a scratch line by means of a knife or the like) were measured.

Figure 2:
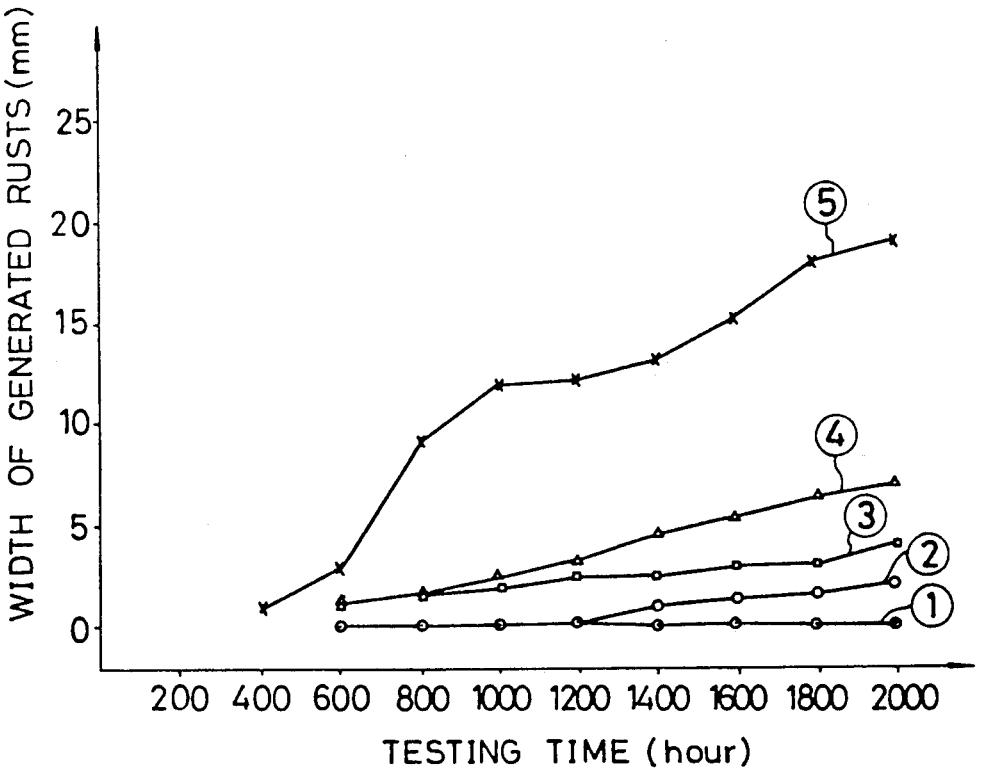
FIG. 2 is a graph showing the results of salt water spray tests.

The results are shown in FIG. 2. It is seen, by comparing test pieces 5 and 4, that the corrosion resistivity was improved by forming an anodic oxide film and, by comparing test pieces 4 and 3 as well as 2 and 1, that the corrosion resistivity was further improved by sealing the anodic oxide film with molybdenum disulfide.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the scope of the invention.

What is claimed is:

1. A rust preventive treatment method for an aluminum basis material comprising the steps of forming an anodic oxide film on a surface of a basis material made of aluminum or aluminum alloy, sealing said anodic oxide film with molybdenum disulfide, and forming at least one paint coat thereon.

2. An outboard motor body made of aluminum or aluminum alloy having on a surface thereof an anodic oxide film sealed with molybdenum disulfide and at least one paint coat on top of said anodic oxide film.

3. The rust preventive treatment method of claim 1, wherein said anodic oxide film is from about 5 to 20 microns thick.

4. The rust preventive treatment method of claim 1, wherein said step of sealing said anodic oxide film comprises anodically electrolyzing said aluminum basis material in an aqueous solution of ammonium thiomolybdate and electrodepositing molybdenum disulfide into minute pores in said anodic oxide film.

5. The rust preventive treatment method of claim 1, further comprising the step of dipping said basis material in an aqueous solution of nickel acetate prior to said step of forming said at least one paint coat.

6. The rust preventive treatment method of claim 1, wherein said step of forming at least one paint coat comprises the steps of forming a primer containing a rust preventive pigment, and subsequently forming a top coat of paint on said primer.

7. The rust preventive treatment method of claim 6, wherein said step of forming at least one paint coat further comprises the step of forming a clear coat on top of said paint top coat.

8. The rust preventive treatment method of claim 1, wherein prior to said step of forming an anodic oxide film, the method comprises the steps of degreasing the surface of said aluminum basis material with sulfuric acid and alkali etching the surface with sodium hydroxide.

9. The rust preventive treatment method of claim 1, wherein said step of forming an anodic oxide film comprises subjecting said aluminum basis material to an anodic oxidation treatment in a sulfuric acid bath to form said anodic oxide film having a thickness of approximately 10 microns.

10. The rust preventive treatment method of claim 4, wherein said step of anodically electrolyzing said aluminum basis material comprises electrolyzing said basis material with an electric current density of 0.25 $A/cm^2$ for 3 to 5 minutes to electrodeposit said molybdenum disulfide.

11. The rust preventive treatment method of claim 4, wherein before and after said step of anodically electrolyzing said aluminum basis material, said aluminum basis material is washed with water.

12. The rust preventive treatment method of claim 6, wherein said primer comprises urethane-modified epoxy ester resin.

13. The rust preventive treatment method of claim 7, wherein said primer, top coat and clear coat are each approximately 25 microns thick.

14. The outboard motor body of claim 2, wherein said anodic oxide film is from about 5 to 20 microns thick.

15. The outboard motor body of claim 2, wherein said molybdenum disulfide is electrodeposited molybdenum disulfide within minute pores of said anodic oxide film.

16. The outboard motor body of claim 2, wherein said at least one paint coat comprises a primer containing a rust preventive pigment and a top coat of paint on said primer.

17. The outboard motor body of claim 16, wherein said at least one paint coat further comprises a clear coat on top of said paint top coat.

18. The outboard motor body of claim 2, wherein said anodic oxide film has a thickness of approximately 10 microns.

19. The outboard motor body of claim 16, wherein said primer comprises urethane-modified epoxy ester resin.

20. The outboard motor body of claim 17, wherein said primer, top coat and clear coat are each approximately 25 microns thick.

* * * * *